US010916195B2

(12) United States Patent
Chang et al.

(10) Patent No.: US 10,916,195 B2
(45) Date of Patent: Feb. 9, 2021

(54) ORGANIC LIGHT EMITTING DISPLAY APPARATUS

(71) Applicant: LG Display Co., Ltd., Seoul (KR)

(72) Inventors: Sungwook Chang, Paju-si (KR); Hoonju Chung, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/513,650

(22) Filed: Jul. 16, 2019

(65) Prior Publication Data

US 2020/0027403 A1 Jan. 23, 2020

(30) Foreign Application Priority Data

Jul. 19, 2018 (KR) ..... 10-2018-0083926

(51) Int. Cl.
*G09G 3/32* (2016.01)
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2310/06* (2013.01);
(Continued)

(58) Field of Classification Search
CPC ..... G09G 3/3233; G09G 2320/0233; G09G 3/3258; G09G 2310/0251; G09G 3/3291; G09G 2320/043; G09G 2320/0257; G09G 2320/0626; G09G 2320/064; G09G 2320/0214; G09G 2320/0242; G09G 3/3208; G09G 2320/045; G09G 2330/021; G09G 2310/066; G09G 3/30; G09G 2320/0209; G09G 3/22; G09G 2310/06;
(Continued)

(56) References Cited

U.S. PATENT DOCUMENTS

2014/0146029 A1* 5/2014 Hong ..... G09G 3/3233 345/212
2015/0364083 A1* 12/2015 Jeon ..... G09G 3/3266 345/76
2016/0210892 A1* 7/2016 Ohara ..... G09G 3/3266

FOREIGN PATENT DOCUMENTS

KR 20070024143 3/2007

* cited by examiner

*Primary Examiner* — Duc Q Dinh
(74) *Attorney, Agent, or Firm* — Polsinelli PC

(57) ABSTRACT

An organic light emitting display apparatus comprises an organic light emitting display panel including a plurality of pixels each including an emission transistor that controls a timing in which an organic light emitting diode emits light; a gate driver outputting gate pulses to a plurality of gate lines provided in the organic light emitting display panel; an emission driver provided in the organic light emitting display panel and outputting an emission signal that controls turn-on and turn-off of the emission transistor to an emission line connected to the emission transistor; a data driver outputting data voltages to a plurality of data lines provided in the organic light emitting display panel; and a controller supplying a first signal and a second signal to the emission driver through one transfer line, wherein the first signal is generated for driving the emission driver when each frame starts, and the second signal is generated for driving the emission driver and has a period shorter than one frame period, and wherein the emission driver generates the emission signal through an emission start signal transferred through the one transfer line.

18 Claims, 8 Drawing Sheets

(52) U.S. Cl.
CPC ..... *G09G 2320/0247* (2013.01); *G09G 2320/0261* (2013.01)

(58) Field of Classification Search
CPC ..... G09G 3/3266; G09G 3/3225; G09G 2300/0842; G09G 2310/0286; G09G 2300/0861; G09G 2310/08; G09G 2300/0819; G09G 2320/0266; G09G 3/3406; G09G 2340/16; G09G 2320/0271
USPC ..... 345/76–84
See application file for complete search history.

1Frame period

1EP
2EP
2EP

DS

1EP
2EP
1EP
1EP
1EP
1EP

DS

A
B
A
B
LA
EM Off
LA
LA
EM Off
LA
LA
EM Off
LA
EM Off
LA
EM Off

ORGANIC LIGHT EMITTING DISPLAY APPARATUS

CROSS REFERENCE TO RELATED APPLICATION

This application claims the priority of Korean Patent Application No. 10-2018-0083926 filed on Jul. 19, 2018, in the Korean Intellectual Property Office, which is incorporated by reference in its entirety.

BACKGROUND

Field of the Disclosure

The present disclosure relates to an organic light emitting display apparatus, and more particularly, to an organic light emitting display apparatus using a duty driving mode.

Description of the Background

An organic light emitting display (OLED) apparatus tends to sensitively respond to characteristics of a thin film transistor (TFT). A characteristic variation of the TFT causes blurring of a screen, and a duty driving mode is being widely used for removing the blurring of the screen.

The duty driving mode is a mode of turning off an emission TFT during a partial period of one frame period to realize a gray level based on an emission time of an organic light emitting diode.

In an organic light emitting display apparatus using the duty driving mode, an emission driver receives an emission start signal at only a start timing of each frame and shifts the emission start signal to supply emission signals to emission TFTs.

In this case, an emission area of an organic light emitting display panel varies in a certain period of one frame period. The emission area of the organic light emitting display panel is proportional to a current supplied to the organic light emitting display panel. That is, when the emission area of the organic light emitting display panel increases, the current supplied to the organic light emitting display panel increases.

When a voltage supplied to the organic light emitting display panel by a voltage supply unit of the organic light emitting display apparatus is constant, an increase in the current supplied to the organic light emitting display panel denotes that the voltage substantially supplied to the organic light emitting display panel is reduced.

When the voltage substantially supplied to the organic light emitting display panel is reduced, a luminance deviation may occur in each region of the organic light emitting display panel, and a duty ratio of the duty driving mode is changed, causing a luminance difference and a flicker defect.

SUMMARY

Accordingly, the present disclosure is directed to providing an organic light emitting display apparatus that substantially obviates one or more problems due to limitations and disadvantages of the related art.

Therefore, the inventors have recognized the above-described problems and have invented an organic light emitting display panel for decreasing a luminance deviation and flickers which occur in each region of the organic light emitting display panel.

An aspect of the present disclosure is directed to providing an organic light emitting display apparatus in which a first signal which is generated for driving an emission driver whenever each frame starts and a second signal which is generated for driving the emission driver and has a period shorter than one frame period are supplied to the emission driver through one transfer line.

Additional advantages and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these and other advantages and in accordance with the purpose of the disclosure, as embodied and broadly described herein, there is provided an organic light emitting display apparatus including an organic light emitting display panel including a plurality of pixels each including an emission transistor that controls a timing in which an organic light emitting diode emits light, a gate driver outputting gate pulses to a plurality of gate lines provided in the organic light emitting display panel, an emission driver provided in the organic light emitting display panel and outputting an emission signal that controls turn-on and turn-off of the emission transistor, to an emission line connected to the emission transistor, a data driver outputting data voltages to a plurality of data lines provided in the organic light emitting display panel, and a controller supplying a first signal and a second signal to the emission driver through one transfer line, the first signal is generated for driving the emission driver when each frame starts, and the second signal is generated for driving the emission driver and has a period shorter than one frame period, and the emission driver generates the emission signal through an emission start signal transferred through the one transfer line.

The second signal may have a same period as a data voltage output period for which the data voltages are output to all of the plurality of pixels during the one frame period.

The controller may control number and width of a pulse of the second signal according to a duty control signal input from an external system.

The emission line may include a plurality of emission lines provided in the organic light emitting display panel. The plurality of emission lines may be arranged in parallel with the plurality of gate lines. The emission signal may be output to each of the plurality of emission lines. The emission driver may output the emission signal, generated by shifting the emission start signal, to each of the plurality of emission lines in a predetermined order.

Each of the plurality of pixels may further comprise a switching transistor connected to one of the plurality of data lines and one of the plurality of gate lines, a driving transistor connected between the organic light emitting diode and a driving voltage supply terminal, to which a first driving voltage is supplied, and turned on or off based on a gate voltage supplied from the switching transistor, and an emission transistor connected between the driving voltage supply terminal and the driving transistor and turned on or off based on the emission signal.

The controller may include an emission control signal generator generating the emission start signal for controlling the emission driver. And the emission control signal generator may include a first signal generator generating the first signal, a second signal generator generating the second signal, and an OR gate performing an OR operation on the first signal and the second signal to generate the emission start signal.

The first signal may include a first pulse output after a vertical synchronization signal defining the one frame period is output.

In another aspect of the present disclosure, there is provided an organic light emitting display apparatus including an organic light emitting display panel including a plurality of pixels each including an emission transistor that controls a timing in which an organic light emitting diode emits light, an emission driver provided in the organic light emitting display panel and outputting an emission signal that controls turn-on and turn-off of the emission transistor, to an emission line connected to the emission transistor, and a controller supplying the emission driver with a first signal generated when each frame starts and a second signal having a period shorter than one frame period, for a constant emission area of the organic light emitting display panel during the one frame period, wherein the emission driver generates the emission signal from a signal supplied from the controller.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate aspects of the disclosure and together with the description serve to explain the principle of the disclosure.

In the drawings.

DETAILED DESCRIPTION

Figure 1:
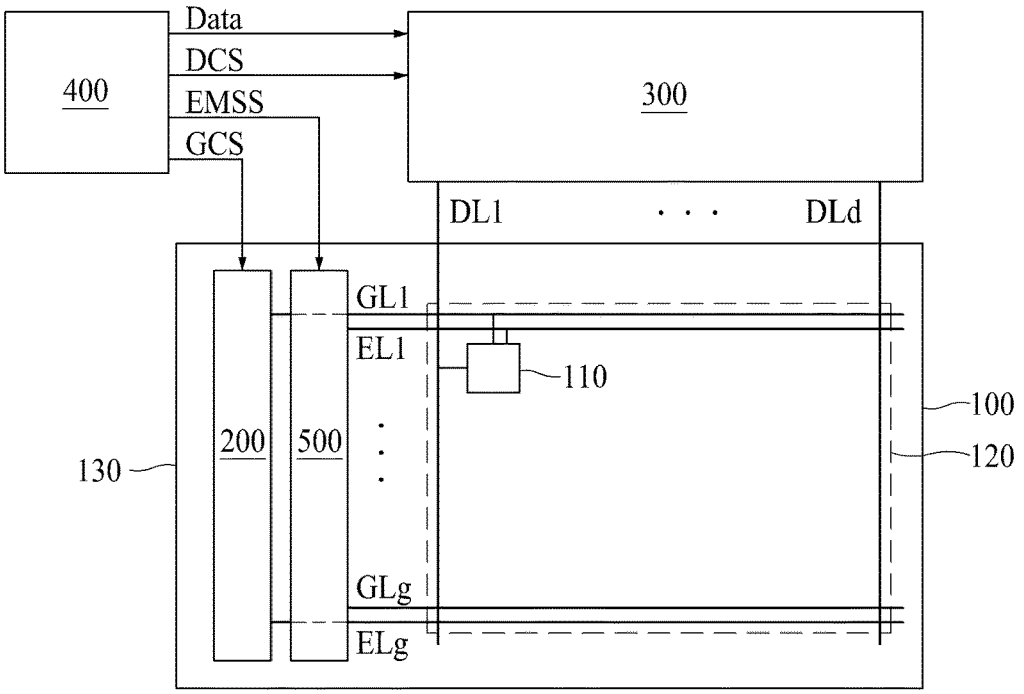
FIG. 1 is an exemplary diagram illustrating a configuration of an organic light emitting display apparatus according to the present disclosure.

Reference will now be made in detail to the exemplary aspects of the present disclosure, examples of which are illustrated in the accompanying drawings. Wherever possible, the same reference numbers will be used throughout the drawings to refer to the same or like parts.

Advantages and features of the present disclosure, and implementation methods thereof will be clarified through following aspects described with reference to the accompanying drawings. The present disclosure may, however, be embodied in different forms and should not be construed as limited to the aspects set forth herein. Rather, these aspects are provided so that this disclosure will be thorough and complete, and will fully convey the scope of the present disclosure to those skilled in the art. Furthermore, the present disclosure is only defined by scopes of claims.

In the specification, in adding reference numerals for elements in each drawing, it should be noted that like reference numerals already used to denote like elements in other drawings are used for elements wherever possible.

A shape, a size, a ratio, an angle, and a number disclosed in the drawings for describing aspects of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted. In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a position relationship, for example, when a position relation between two parts is described as 'on~', 'over~', 'under~', and 'next~', one or more other parts may be disposed between the two parts unless 'just' or 'direct' is used.

In describing a time relationship, for example, when the temporal order is described as 'after~', 'subsequent~', 'next~', and 'before~', a case which is not continuous may be included unless 'just' or 'direct' is used.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

Features of various aspects of the present disclosure may be partially or overall coupled to or combined with each other, and may be variously inter-operated with each other and driven technically as those skilled in the art can sufficiently understand. The aspects of the present disclosure may be carried out independently from each other, or may be carried out together in co-dependent relationship.

Hereinafter, aspects of the present disclosure will be described in detail with reference to the accompanying drawings.

Figure 2:
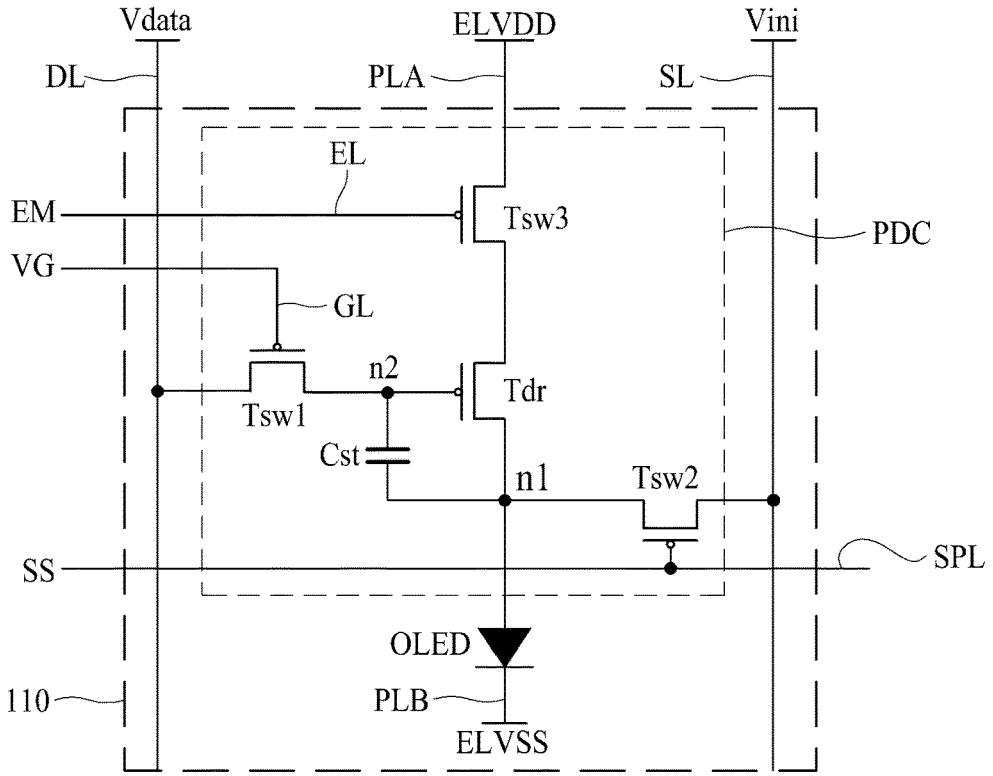
FIG. 2 is an exemplary diagram illustrating a configuration of one pixel of an organic light emitting display apparatus according to the present disclosure.
Figure 3:
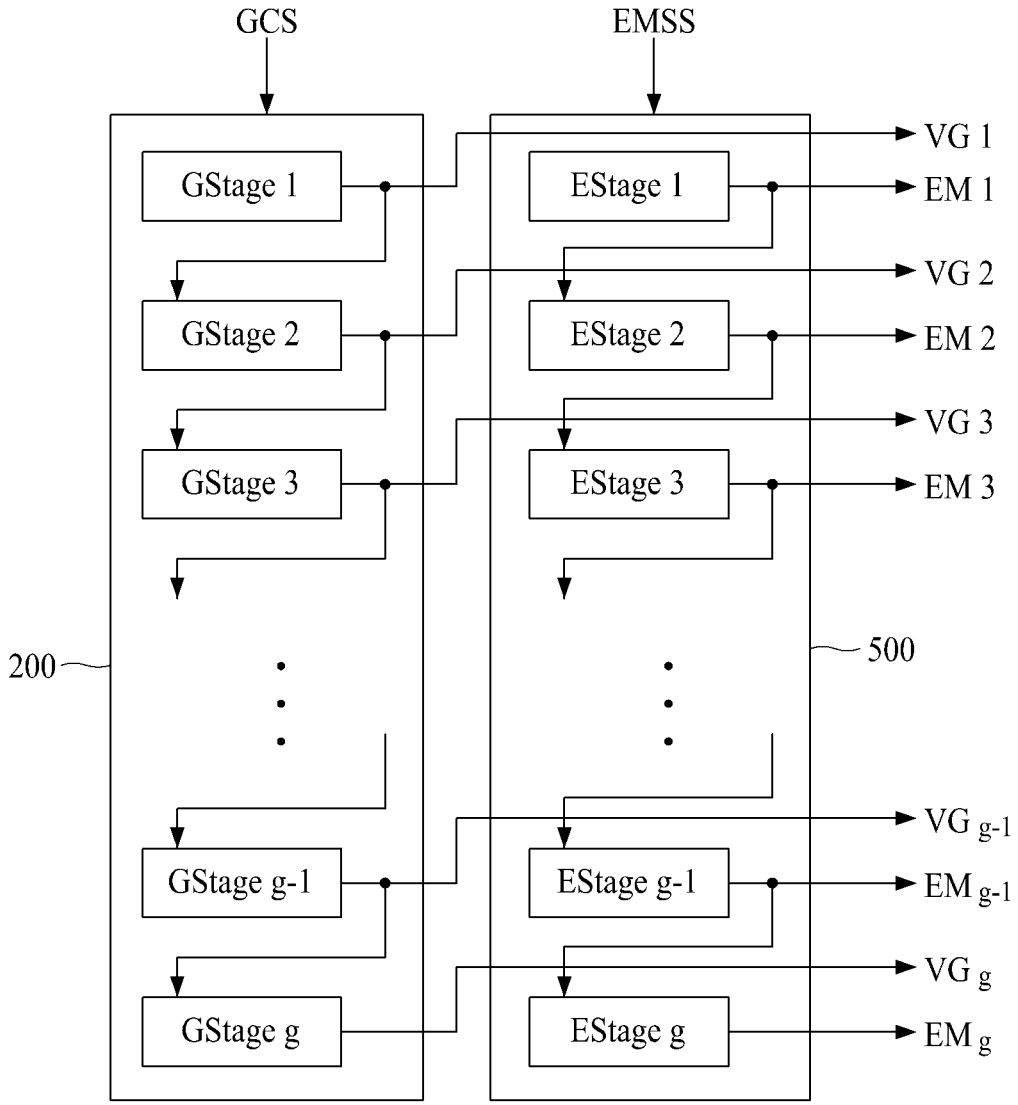
FIG. 3 is an exemplary diagram illustrating a configuration of each of a gate driver and an emission driver of an organic light emitting display apparatus according to the present disclosure.
Figure 4:
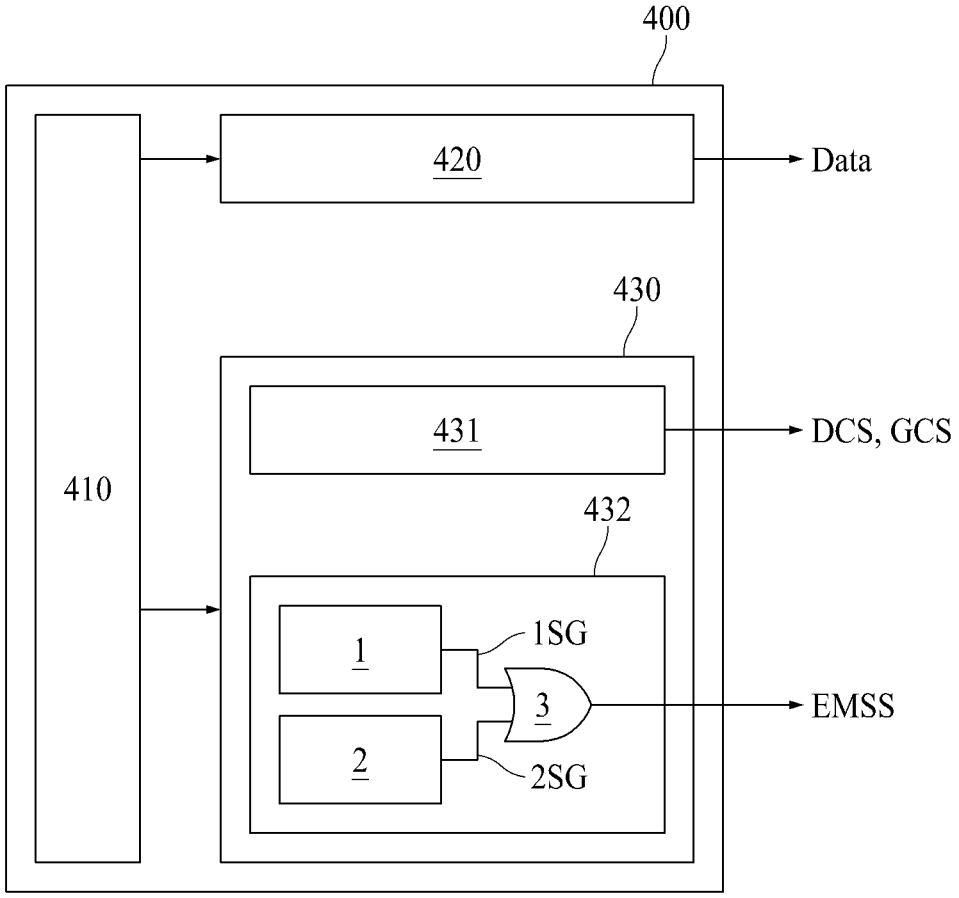
FIG. 4 is an exemplary diagram illustrating a configuration of a controller applied to an organic light emitting display apparatus according to the present disclosure.

FIG. 1 is an exemplary diagram illustrating a configuration of an organic light emitting display apparatus according to the present disclosure. FIG. 2 is an exemplary diagram illustrating a configuration of one pixel of the organic light emitting display apparatus according to the present disclosure. FIG. 3 is an exemplary diagram illustrating a configuration of each of a gate driver and an emission driver of the organic light emitting display apparatus according to the present disclosure. FIG. 4 is an exemplary diagram illustrating a configuration of a controller applied to the organic light emitting display apparatus according to the present disclosure. FIGS. 5A-5F are exemplary diagrams showing waveforms of signals applied to the organic light emitting display apparatus according to the present disclosure.

The organic light emitting display apparatus according to the present disclosure, as illustrated in FIGS. 1 and 2, may include an organic light emitting display panel 100, a data driver 300, a gate driver 200, an emission driver 500, and a controller 400.

Hereinafter, the elements will be sequentially described.

The organic light emitting display panel 100 may include an emission transistor Tsw3 for controlling a timing at which an organic light emitting diode OLED emits light, and the emission transistor Tsw3 may be provided in each of a plurality of pixels 110 configuring the organic light emitting display panel 100.

A plurality of gate lines GL1 to GLg and a plurality of data lines DL1 to DLd may be provided in the organic light emitting display panel 100, and the emission transistor Tsw3 and the organic light emitting diode OLED may be provided in each of the pixels 110.

The organic light emitting display panel 100 may include a display area 120 where the pixels 110 displaying an image is provided and a non-display area 130 which surrounds an outer portion of the display area 120.

Each of the pixels 110, as illustrated in FIG. 2, may include the organic light emitting diode OLED and a pixel driver PDC.

A plurality of signal lines DL, EL, GL, PLA, PLB, SL, and SPL for transferring a driving signal to the pixel driver PDC may be provided in each of the pixels 110.

A data voltage Vdata may be supplied through a data line DL, a gate signal VG may be supplied through a gate line GL, a first driving voltage ELVDD may be supplied through a first driving voltage supply line PLA, a second driving voltage ELVSS may be supplied through a second driving voltage supply line PLB, a sensing voltage Vini may be supplied through a sensing line SL, a sensing control signal SS for turning on a sensing transistor Tsw2 may be supplied through a sensing pulse line SPL, and an emission signal EM for driving the emission transistor Tsw3 may be supplied through an emission line EL.

A plurality of emission lines EL1 to ELg may be provided in the organic light emitting display panel 100 and may be arranged in parallel with the gate lines, and the emission signal EM may be output to each of the emission lines. The emission transistor Tsw3 may be turned on or off by the emission signal EM.

As illustrated in FIG. 2, for example, the pixel driver PDC may include the organic light emitting diode OLED, a switching transistor Tsw1 which is connected to one of the data lines and one of the gate lines, a driving transistor Tdr which is connected between the organic light emitting diode OLED and a driving voltage supply terminal to which the first driving voltage ELVDD is supplied and is turned on or off based on a gate voltage supplied from the switching transistor, the emission transistor Tsw3 which is connected between the driving voltage supply terminal and the driving transistor, the sensing transistor Tsw2 which is connected between the sensing line SL and the organic light emitting diode OLED, and a storage capacitor Cst which is connected between a second node n2 connected to a gate of the driving transistor Tdr and a first node n1 connected to a source of the driving transistor Tdr and induces a storage capacitance. In the pixel driver PDC illustrated in FIG. 2, the transistors may be configured as P-type transistors, but are not limited thereto and may be configured as N-type transistors.

The switching transistor Tsw1 may be turned on by a gate pulse of the gate signal supplied through the gate line GL and may transfer the data voltage Vdata, supplied through the data line DL, to the gate of the driving transistor Tdr. That is, the switching transistor Tsw1 may transfer the data voltage Vdata to the driving transistor Tdr according to the gate pulse.

The sensing transistor Tsw2 may be connected between the sensing line SL and the first node n1 between the driving transistor Tdr and the organic light emitting diode OLED and may be turned on by a sensing pulse of the sensing control signal SS to sense a characteristic of the driving transistor Tdr.

The emission transistor Tsw3 may be turned on or off by the emission signal EM and may transfer the first driving voltage ELVDD and a current to the driving transistor Tdr or may cut off the first driving voltage ELVDD and the current. That is, the switching transistor Tsw1 may transfer the data voltage Vdata to the driving transistor Tdr according to the gate pulse.

The driving transistor Tdr may control the amount of current flowing to the organic light emitting diode OLED. The second node n2 connected to the gate of the driving transistor Tdr may be connected to the switching transistor Tsw1.

A structure of the pixel driver PDC may be implemented as various structures in addition to a structure illustrated in FIG. 2.

The data driver 300 may convert pieces of image data Data, input from the controller 400, into analog data voltages and may transfer the pieces of image data Data of one horizontal line to the data lines DL1 to DLd at every one horizontal period where the gate pulse is supplied to the gate line GL. The data driver 300 may transfer the sensing voltage *Vini* to the second transistor Tsw2.

The gate driver 200 may output gate pulses to the gate lines GL1 to GLg included in the organic light emitting display panel 100. The emission driver 500 may output the emission signal EM, which turns on or off the emission transistor Tsw3, to the emission line EL which is provided in the organic light emitting display panel 100 and is connected to the emission transistor Tsw3.

The gate signal may include the gate pulse and a gate-off signal. The gate pulse may turn on the switching transistor Tsw1, and the gate-off signal may turn off the switching transistor Tsw1.

The emission signal may include a signal for turning on the emission transistor Tsw3 and a signal for turning off the emission transistor Tsw3.

The gate driver 200 and the emission driver 500 may be mounted on a chip-on film (COF) and may be connected to the organic light emitting display panel 100, but are not limited thereto and may be directly provided in the non-display area 130.

As illustrated in FIG. 3, the gate driver 200 may include a plurality of gate stages Gstage 1 to Gstage g, and the gate stages Gstage 1 to Gstage g may respectively generate gate signals VG1 to VGg. In this case, the gate stages of the gate driver 200 may be connected to the gate lines GL1 to GLg. The gate signals output from the gate driver 200 may be supplied to the gate lines GL1 to GLg. In this case, each of the gate signals may be used as a signal for driving the emission driver 500. Also, emission signals EM output from the emission driver 500 may be supplied to emission lines EL1 to ELg. In this case, each of the emission signals may be used as a signal for driving the gate driver 200.

The gate pulse included in the gate signal VG may be transferred to the gate stages in a predetermined order, and each of the gate stages may supply the gate pulse to a gate line connected thereto. The gate driver 200 may be driven by a gate control signal GCS transferred from the controller 400.

The emission driver, as illustrated in FIG. 3, may include a plurality of emission stages Estage 1 to Estage g, and the emission stages Estage 1 to Estage g may respectively generate emission signals EM1 to EMg. In this case, the emission stages of the emission driver 500 may be connected to the emission lines EM. The emission signal EM may be transferred to the emission stages in a predetermined order, and each of the emission stages may supply the emission signal EM to an emission line EL connected thereto. The emission driver 500 may generate the emission signal EM by using an emission start signal EMSS transferred from the controller 400. The emission signal EM generated by one emission stage may be transferred to the emission stages of the emission driver 500 in a predetermined order and may be output to the emission line EL.

The gate driver 200 and the emission driver 500 may each be configured as various types in addition to a structure illustrated in FIG. 3.

The controller 400 may supply a first signal 1SG and a second signal 2SG to the emission driver 500 through one transfer line. Here, the first signal 1SG may be generated for driving the emission driver 500 whenever each frame starts, and the second signal 2SG may be generated for driving the emission driver 500 and may have a period which is shorter than one frame period. In this case, as illustrated in FIG. 3, the emission driver 500 may generate the emission signal EM by using the emission start signal EMSS transferred through a transfer line.

In order to generate the emission signal EM, as illustrated in FIG. 4, the controller 400 may include a receiver 410 which receives pieces of input video data and timing signals (for example, a vertical synchronization signal, a horizontal synchronization signal, and a clock) from an external system, a control signal generator 430 which generates the gate control signal GCS for controlling the gate driver 200, a data control signal DCS for controlling the data driver 300, and the emission start signal EMSS for controlling the emission driver 500, based on the timing signals, and a data aligner 420 which samples and realigns the pieces of input video data to generate pieces of image data Data and supplies the pieces of image data Data to the data driver 300.

The control signal generator 430 may include a basic control signal generator 431 which generates the gate control signal GCS and the data control signal DCS and an emission control signal generator 432 which generates the emission start signal EMSS.

The emission control signal generator 432 may include a first signal generator 1 which generates the first signal 1SG, a second signal generator 2 which generates the second signal 2SG, and an OR gate 3 which performs an OR operation on the first signal 1SG and the second signal 2SG.

Figure 5:
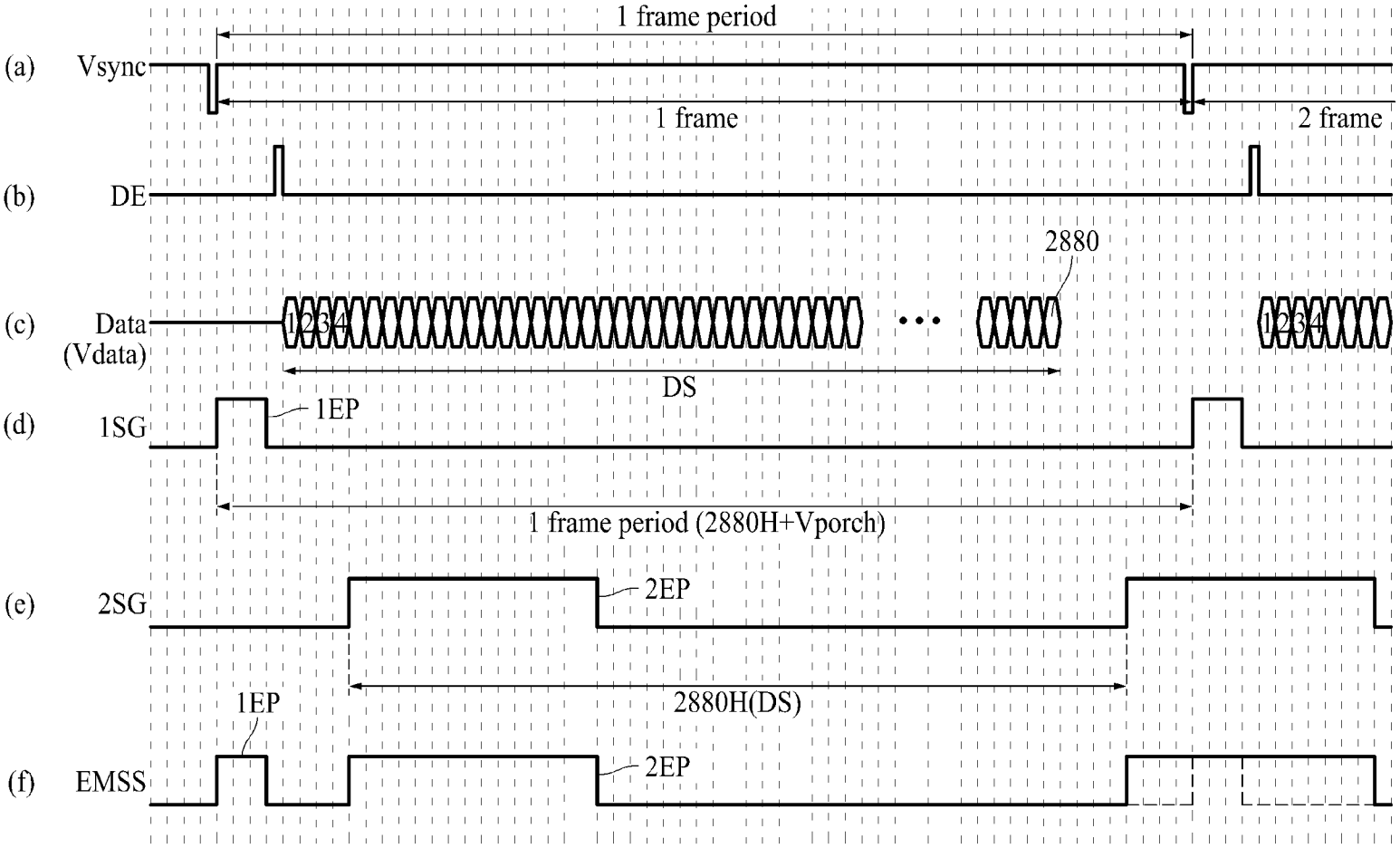
FIGS. 5A-5F are exemplary diagrams showing waveforms of signals applied to an organic light emitting display apparatus according to the present disclosure.

As shown in FIG. 5D, for example, the first signal 1SG may include a first pulse 1EP which is output after a vertical synchronization signal Vsync shown in FIG. 5A is output. The vertical synchronization signal Vsync may define one frame period. That is, one frame period may be a period until one vertical synchronization signal Vsync is output and then another vertical synchronization signal Vsync is output. Also, in the following description, one image displayed by the organic light emitting display panel may be referred to as a frame. A 1 frame may denote a first image, and a 2 frame may denote a second image.

Moreover, a frame may be used as a meaning similar to a period.

Each of the 1 frame and the 2 frame may be output in one frame period. Therefore, the 1 frame may denote an image which is displayed in one frame period, and the 2 frame may denote an image which is displayed in another one frame period.

The first pulse 1EP may have a pulse width of two to eight horizontal periods. One horizontal period, as shown in FIG. 5C, may denote a period where the data voltage Vdata is output to the data line DL. The data voltage Vdata may be output to the data line DL during one horizontal period 1H when the gate pulse is supplied to the gate line GL.

The vertical synchronization signal Vsync may be output, and then, an enable signal DE shown in FIG. 5B may be output. Subsequently, data voltages Vdata may be output to the data lines.

The first pulse 1EP may be output after the vertical synchronization signal Vsync is output, and thus, like a vertical synchronization pulse, the first pulse 1EP may be output at every one frame period. That is, the first pulse 1EP may have a period corresponding to one frame period.

For example, when the number of gate lines GL1 to GLg is 2,880, data voltages may be output through the data lines during 2,880 horizontal periods 2880H in one frame period, and during the other period (hereinafter simply referred to as a vertical blank period), data voltages may not be output to the data lines. Therefore, one frame period may include the 2,880 horizontal periods 2880H and a vertical blank period.

As shown in FIG. 5E, for example, the second signal 2SG may include at least one second pulse 2EP which is output after at least one horizontal period 1H elapses after the first pulse 1EP is output.

The second pulse 2EP may have various pulse widths on the basis of a duty ratio, and for example, a second emission pulse 2EP shown in FIGS. 5A-5F may have a pulse width corresponding to 15H.

The second signal 2SG may have a period which is shorter than one frame period, and particularly, may have the same period as a data voltage output period DS where data voltages are output to all pixels provided in the display area in one frame period.

For example, in a case where the data voltages Vdata are output during 2,880 horizontal periods 2880H, the second signal 2SG may also have a period corresponding to 2880H.

The emission control signal generator 432 may generate the first signal 1SG and the second signal 2SG each having the above-described period and may perform an OR operation on the first signal 1SG and the second signal 2SG by using the OR gate 3.

When the OR gate 3 performs an OR operation on the first signal 1SG and the second signal 2SG, the emission start signal EMSS shown in FIG. 5F may be generated.

The emission start signal EMSS may be generated by performing an OR operation on the first signal 1SG and the second signal 2SG, and thus, the emission start signal EMSS may include the first pulse 1EP and the at least one second pulse 2EP.

In this case, the first pulse 1EP may have a period corresponding to one frame period, and thus, as shown in FIG. 5F, the first pulse 1EP may be output at every frame.

However, the second pulse 2EP may have a period (for example, the same period as the data voltage output period DS) which is shorter than one frame period, and thus, as shown in FIG. 5F, the second pulse 2EP may be output twice in one frame period.

For example, when a 1 frame starts in FIG. 5F, the first pulse 1EP may be output, the second pulse 2EP may be output after 5H elapses after the first pulse 1EP is output, and the second pulse 2EP may be output again after 2880H elapses after the second pulse 2EP is output, and then, when one frame period elapses, the first pulse 1EP may be output.

Therefore, the second pulse 2EP may overlap the first pulse 1EP, and in this case, as shown in FIG. 5F, when a 2 frame starts, the first pulse 1EP may be shown like not being output, but may be substantially output.

The emission driver 500 may receive the emission start signal EMSS having a waveform shown in FIG. 5F, shift the emission start signal EMSS to generate the emission signal EM, and output the generated emission signal EM to each of the emission lines EL in a predetermined order.

In this case, as illustrated in FIG. 2, since the emission transistor Tsw2 is configured as a P type, when the emission signal EM generated from the received emission start signal EMSS shown in FIG. 5F is supplied to the emission transistor Tsw3, the emission transistor Tsw3 may be turned off based on a high level of the emission signal EM and may be turned on based on a low level of the emission signal EM.

A method of controlling light emitted from the organic light emitting diode OLED by the emission signal EM will be simply described below.

First, for example, in the emission start signal EMSS shown in FIG. 5F, when the first pulse 1EP having a high level is supplied to a gate of the emission transistor Tsw3, the emission transistor Tsw3 may be turned off. When the emission transistor Tsw3 is turned off, the first driving voltage ELVDD and a current may not be supplied to the driving transistor Tdr and the organic light emitting diode OLED through the emission transistor Tsw3, and thus, the organic light emitting diode OLED may not emit light. A sensing operation of the driving transistor Tdr may be performed while the first pulse 1EP is being output.

The sensing operation may be for sensing a variation of mobility of the driving transistor Tdr or a change in a degree of degradation of the driving transistor Tdr and may be performed by using various methods which are being currently used. The sensing operation does not correspond to a feature of the present disclosure, and thus, its detailed description is omitted.

Second, when the emission signal EM having a low level is received after the first pulse 1EP is output, the emission transistor Tsw3 may be turned on. When the emission transistor Tsw3 is turned on, the first driving voltage ELVDD and the current based on the first driving voltage ELVDD may be supplied to the driving transistor Tdr through the emission transistor Tsw3, and thus, the organic light emitting diode OLED may emit light.

Third, when the second pulse 2EP having a high level is supplied to the gate of the emission transistor Tsw3 after the organic light emitting diode OLED emits the light, the emission transistor Tsw3 may be turned off again, and thus, the organic light emitting diode OLED may not again output light.

Fourth, when the emission signal EM having a low level is received again after the second pulse 2EP is output, the emission transistor Tsw3 may be turned on again, and thus, the organic light emitting diode OLED may again emit light.

Fifth, when the second pulse 2EP having a high level is supplied to the gate of the emission transistor Tsw3 again after the organic light emitting diode OLED emits the light, the emission transistor Tsw3 may be turned off again, and thus, the organic light emitting diode OLED may not again output light.

The processes may be performed during one frame period.

Since the organic light emitting diode OLED outputs light or not through the processes, namely, since the organic light emitting diode OLED is turned on and off, the intensity of light which is emitted from the organic light emitting diode OLED during one frame period may be reduced compared to the intensity of light which is continuously emitted from the organic light emitting diode OLED.

That is, according to the present disclosure, the number or interval of turn-on and turn-off of the organic light emitting diode OLED may be controlled, and thus, the intensity (for example, luminance) of light emitted from the organic light emitting diode OLED may be controlled.

To provide an additional description, the organic light emitting display apparatus according to the present disclosure may realize low luminance through the turn-on and turn-off of the organic light emitting diode OLED.

Figures 6A, 6B, 6C, 6D, 6E:
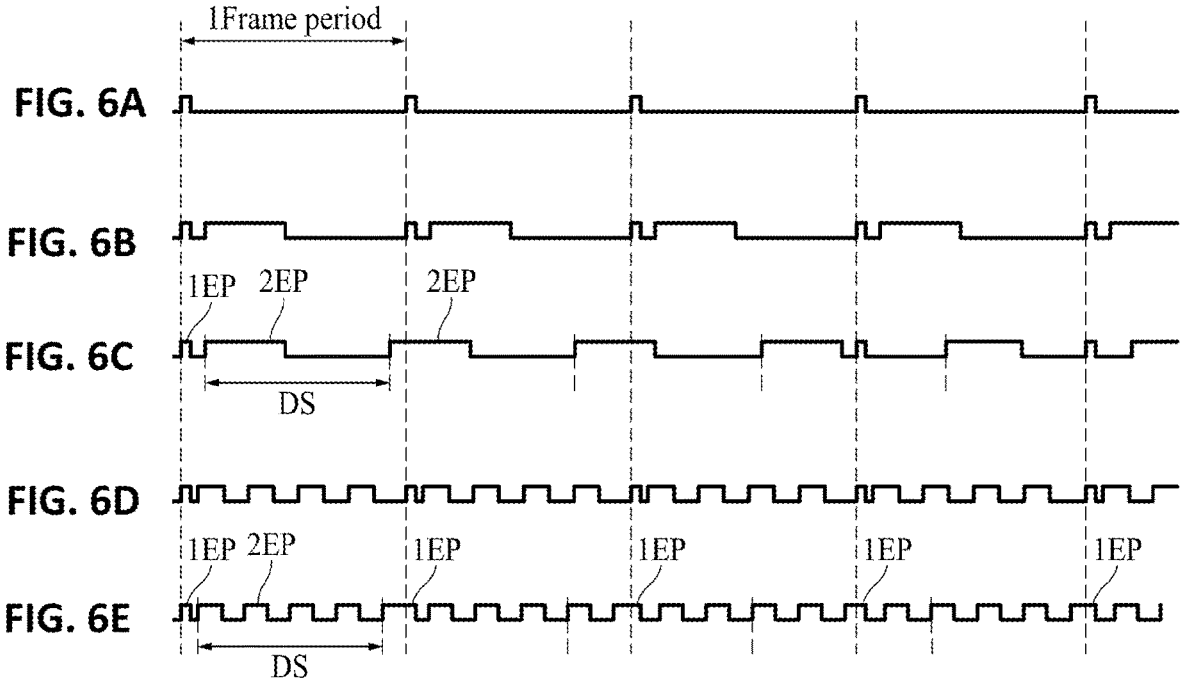
FIGS. 6A-6E are exemplary diagrams showing emission signals applied to an organic light emitting display apparatus according to the present disclosure and an emission signal of a comparative example.
Figure 7:
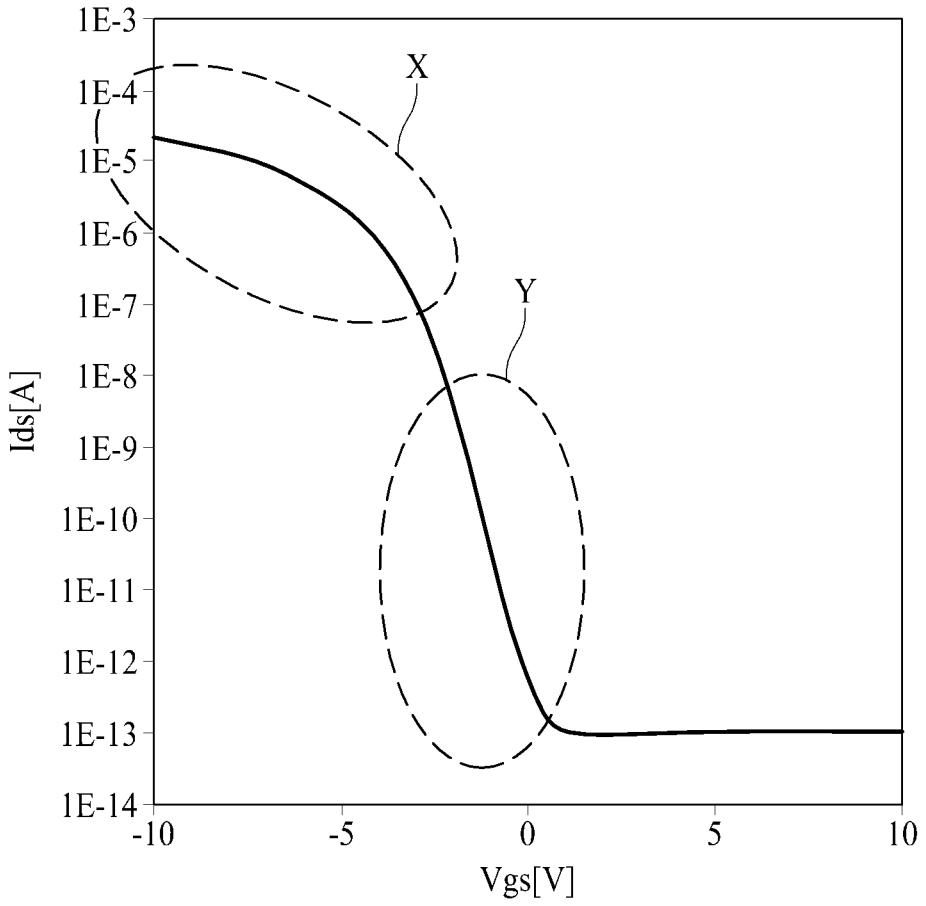
FIG. 7 is a graph of an aspect showing a characteristic of a thin film transistor applied to an organic light emitting display apparatus according to the present disclosure.

FIGS. 6A-6E are exemplary diagrams showing emission signals applied to an organic light emitting display apparatus according to the present disclosure and an emission signal of a comparative example, and FIG. 7 is a graph of an aspect showing a characteristic of a thin film transistor applied to an organic light emitting display apparatus according to the present disclosure. Particularly, FIG. 7 is a graph showing a relationship between a gate-source voltage Vgs of the driving transistor Tdr and a current Ids flowing to the organic light emitting diode OLED.

First, FIG. 6A shows an emission signal of the comparative example. In the emission signal of the comparative example, as shown in FIG. 6A, only a signal corresponding to the first pulse 1EP may be output to the emission line at every frame. When the first pulse 1EP is output and thus the emission transistor Tsw3 is turned off, a sensing operation may be performed on the driving transistor Tdr.

Particularly, FIG. 6A shows an emission signal applied to an organic light emitting display apparatus to which a duty driving mode applied to the present disclosure is not applied.

FIG. 6B shows an emission signal applied to an organic light emitting display apparatus of the comparative example using the duty driving mode. FIG. 6C shows an emission signal applied to an organic light emitting display apparatus according to the present disclosure using the duty driving mode.

In the organic light emitting display apparatus of the comparative example using the duty driving mode, as shown in FIG. 6B, pulses corresponding to the first pulse 1EP and the second pulse 2EP of the present disclosure may be output to the emission line at the same timing at every frame.

In this case, as described in the background, a period where an emission area of the organic light emitting display panel varies may occur in one frame period, and due to this, a luminance deviation may occur in each region of the organic light emitting display panel and a flicker defect may occur.

However, in the organic light emitting display apparatus according to the present disclosure, the emission signal shown in FIG. 6C may be supplied to the emission transistor, and thus, the above-described problems of the related art may not occur. Descriptions relevant thereto will be given below with reference to FIGS. 8 and 9.

Finally, FIG. 6D shows another emission signal applied to the organic light emitting display apparatus of the comparative example using the duty driving mode. FIG. 6C shows another emission signal applied to the organic light emitting display apparatus according to the present disclosure using the duty driving mode.

In the duty driving mode, as described above, the intensity of light emitted from the organic light emitting diode may be controlled by turning on and off the organic light emitting diode, and thus, the luminance of the organic light emitting display apparatus may be controlled.

For example, when a user selects a menu item for wholly darkening an image displayed by a general organic light emitting display apparatus by using a setting menu of the general organic light emitting display apparatus, the general organic light emitting display apparatus may correct piece of input video data to wholly decrease levels of data voltages supplied to data lines.

In this case, the driving transistor Tdr may operate in a Y region of FIG. 7.

However, when the driving transistor Tdr operates in the Y region, a variation amount of the current Ids which flows to the organic light emitting diode OLED on the basis of a variation of the gate-source voltage Vgs of the driving transistor Tdr may be large. Therefore, it is not easy to control brightness of the organic light emitting diode OLED, and in this case, there is a high possibility that a blurring defect occurs in the organic light emitting display panel.

However, when the driving transistor Tdr operates in an X region of FIG. 7, a variation amount of the current Ids which flows to the organic light emitting diode OLED on the basis of a variation of the gate-source voltage Vgs of the driving transistor Tdr may not be large. Therefore, it is not easy to control brightness of the organic light emitting diode OLED, and in this case, a blurring defect may not occur in the organic light emitting display panel, or may slightly occur.

In the duty driving mode, in a case where luminance of an image displayed by the organic light emitting display apparatus should be wholly darkened, the organic light emitting display apparatus may control the turn-on and turn-off of the emission transistor Tsw3 to control luminance of the organic light emitting diode OLED, instead of performing an operation of correcting piece of input video data to wholly decrease levels of data voltages supplied to data lines.

To provide an additional description, the duty driving mode may be a mode where, in a case where luminance of an image should be wholly darkened, the emission transistor Tsw3 turns on and off the organic light emitting diode OLED to increase a period where the organic light emitting diode OLED does not emit light, and thus, lowers luminance of the organic light emitting diode OLED to wholly lower luminance of an image displayed by the organic light emitting display apparatus.

To provide an additional description, for example, in the duty driving mode applied to the organic light emitting display apparatus having a pixel structure illustrated in FIG. 2, even in a case where a low level signal and a high level signal are repeated a plurality of times, when a time for which a high level is maintained is constant, the same luminance may be output, and when a time for which a high level is maintained increase, luminance may be reduced.

However, in a case where the organic light emitting diode should emit light for only a time corresponding to 10% of a total emission time of the organic light emitting diode so as to realize low luminance, when an emission signal having a 90% high level and a 10% low level is supplied, a time for which a screen is turned off may increase, and due to this, the organic light emitting diode may be vulnerable to flickers.

In order to solve such a problem, a high level and a low level may be repeated a plurality of times as shown in FIGS. 6D and 6E. For example, when an emission signal having a 45% high level, a 5% low level, and a 45% high level and a 5% low level is supplied, the same luminance as luminance when an emission signal having a 90% high level and a 10% low level is supplied may be maintained, and flickers may be reduced.

Therefore, when flickers occur in an image based on the emission signal described above with reference to FIGS. 6B and 6C, flickers may decrease by using an emission signal shown in FIGS. 6D and 6E.

Moreover, when a time for which a high level of the emission signal shown in FIGS. 6D and 6E is maintained is longer than a time for which a high level of the emission signal shown in FIGS. 6B and 6C is maintained, a time for which the organic light emitting diode OLED emits light may more decrease, and thus, the intensity of light which is emitted from the organic light emitting diode OLED during one frame period. Therefore, the intensity of light which is emitted from the organic light emitting diode OLED when the emission signal shown in FIGS. 6D and 6E is applied may be less than that of light which is emitted from the organic light emitting diode OLED when the emission signal shown in FIGS. 6B and 6C is applied. Accordingly, the luminance of the organic light emitting display apparatus may be more reduced.

In this case, in the organic light emitting display apparatus of the comparative example using the duty driving mode, as shown in FIG. 6D, since pulses corresponding to the first pulse 1EP and the second pulse 2EP of the present disclosure are output to the emission line at the same timing at every frame, a period where an emission area of the organic light emitting display panel varies may occur in one frame period, and due to this, a luminance deviation may occur in each region of the organic light emitting display panel and a flicker defect may occur.

However, in the organic light emitting display apparatus according to the present disclosure, since the emission signal shown in FIG. 6E is supplied to the emission transistor, problems such as a luminance deviation and flickers may not occur.

That is, as shown in FIG. 6C, an emission signal applied to the present disclosure may include a first pulse 1EP having a period corresponding to one frame period and one second pulse 2EP which is repeatedly output at a period shorter than one frame period, or as shown in FIG. 6E, may include a first pulse 1EP having a period corresponding to one frame period and two or more second pulses 2EP which are repeatedly output at a period shorter than one frame period.

The number and widths of second pulses 2EP may be variously changed based on the luminance of the organic light emitting display apparatus which is to be controlled based on the duty driving mode.

That is, the controller 400 may control the number and widths of pulses configuring the second signal 2SG, based on a duty control signal input from the external system.

Figures 8A, 8B:
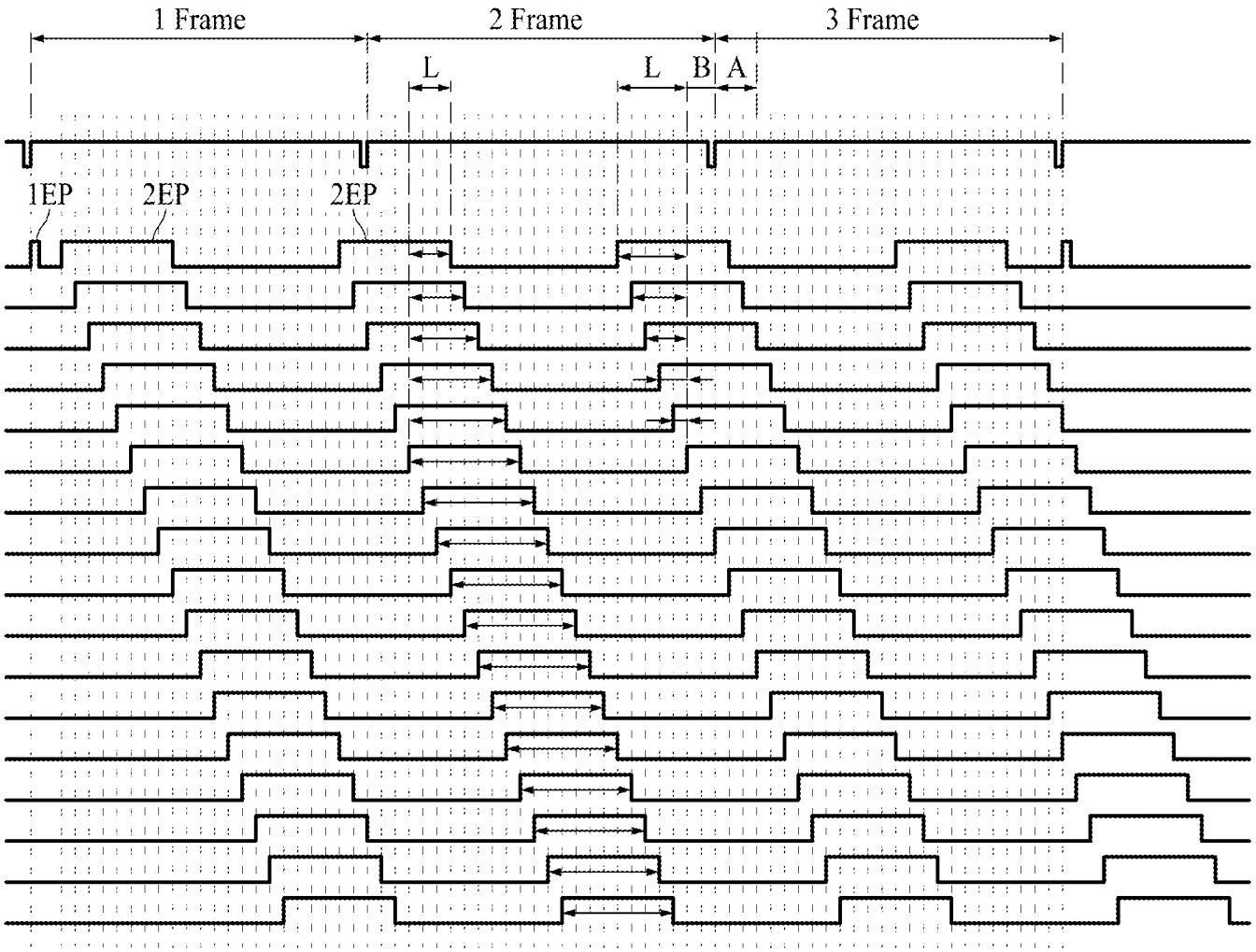
FIGS. 8A-8B are exemplary diagrams showing an emission signal applied to an organic light emitting display apparatus according to the present disclosure.
Figure 9:
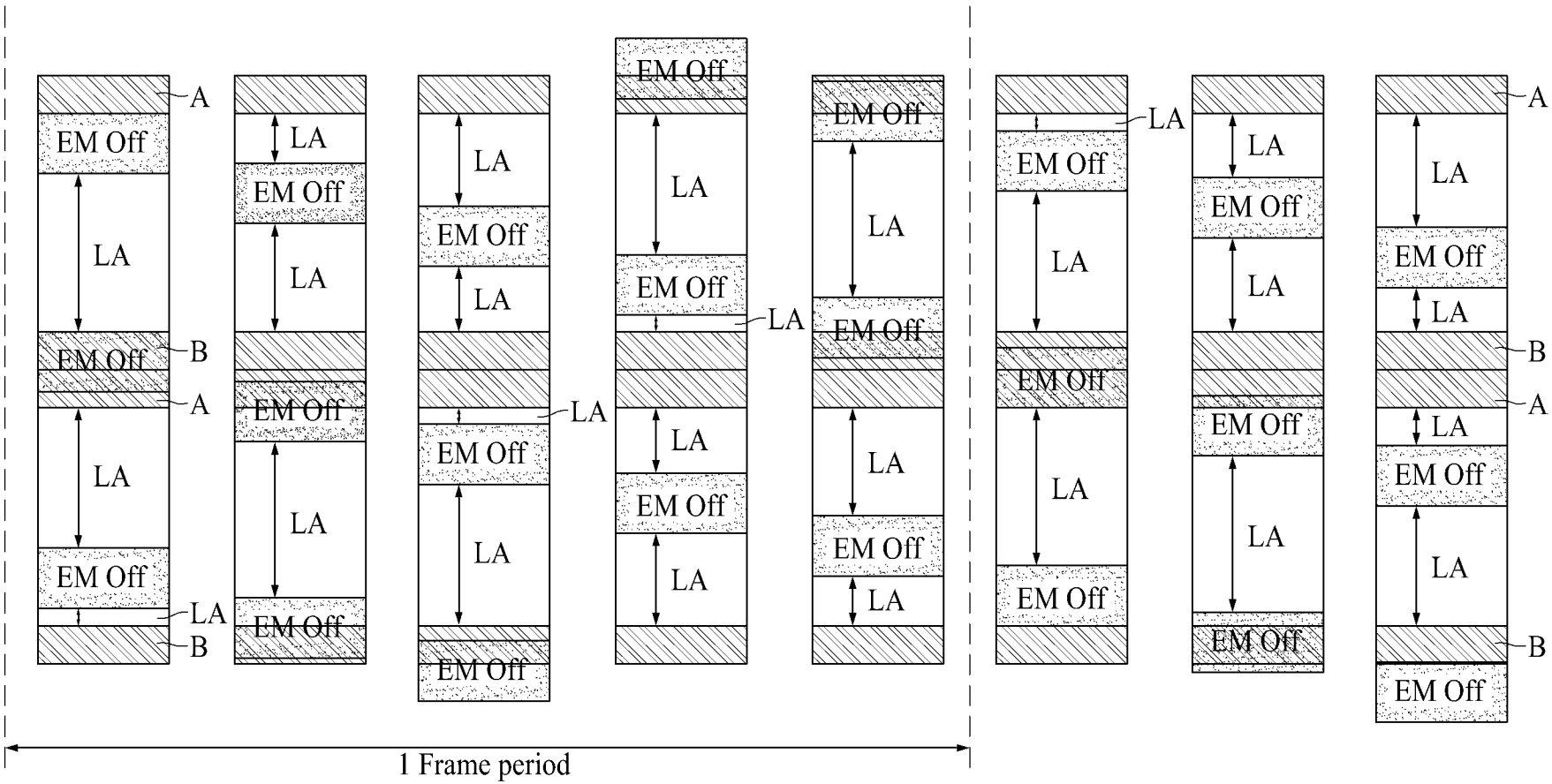
FIG. 9 is an exemplary diagram illustrating an area of a region, displaying an image, of an organic light emitting display panel of an organic light emitting display apparatus according to the present disclosure.

FIGS. 8A and 8B are exemplary diagrams showing an emission signal applied to an organic light emitting display apparatus according to the present disclosure, and FIG. 9 is an exemplary diagram illustrating an area of a region, displaying an image, of an organic light emitting display panel of an organic light emitting display apparatus according to the present disclosure. Here, FIG. 8A shows a vertical synchronization signal Vsync, and FIG. 8B shows an emission signal. Particularly, in FIG. 8B, the ordinate axis represents an emission signal output to each of emission lines EL included in an organic light emitting display panel, and the abscissa axis represents a frame. In this case, after a second pulse 2EP of an emission signal shown in a lowermost end of a first frame, a second pulse 2EP of an emission signal shown in an uppermost end of the first frame is output. That is, FIG. 8B shows a time and a position of a physical organic light emitting display panel to which a second pulse 2EP of an emission signal is output.

To provide an additional description, when a 1 frame starts, a first pulse 1EP and a second pulse 2EP each shown in an uppermost end (i.e., a first line) of FIG. 8B may be output to an emission line (i.e., a first emission line) provided in an uppermost end of an organic light emitting display panel. The second pulse 2EP is output, and after 1H elapses, a second pulse 2EP shown in a second line of FIG. 8B is output to a second emission line. Through such a process, the second pulse 2EP is sequentially output to emission lines.

In this case, when it is assumed that data voltages shown in FIG. 5C are output, the processes may be repeated, and when 2879H elapses after the second pulse 2EP is output to the first emission line, the second pulse 2EP may be output to an emission line (for example, a 2880th emission line) provided in a lowermost end (i.e., a lowermost end of FIG. 8B) of the organic light emitting display panel.

After 1H elapses after the second pulse 2EP is output to the 2880th emission line, the second pulse 2EP may be output to the first emission line. When the second pulse 2EP is output to the second emission line after 1H elapses after the second pulse 2EP is output to the 2880th emission line, the 1 frame may end.

In a 2 frame, the second pulse 2EP output to the second emission line may be continuously output to the second emission line during 6H.

After 1H elapses after the second pulse 2EP is output to the second emission line, the second pulse 2EP may be output to a third emission line.

Since the pulses are continuously output through the above-described processes, a period where organic light emitting diodes respectively connected to emission lines emit lights may be controlled.

In this case, for example, as shown in FIGS. 8A and 8B, data voltages may not be output to data lines during 2H immediately before each frame starts and during 3H immediately after each frame starts. Such a period may be referred to as a vertical blank period.

In the following description, a period corresponding to 2H immediately before each frame starts may be referred to as a rear stage vertical blank period B, and a period corresponding to 3H immediately after each frame starts may be referred to as a front stage vertical blank period A.

That is, the rear stage vertical blank period B may denote a certain period immediately before the vertical synchronization signal Vsync is output, and the front stage vertical blank period A may denote a certain period immediately after the vertical synchronization signal Vsync is output. A vertical blank period including the front stage vertical blank period A and the rear stage vertical blank period B may be referred to by Vporch in FIG. 5D. That is, a 1 frame period in FIG. 5D may include 2880H (i.e., a data voltage output period DS) for which data voltages are output and the vertical block period Vporch which is a sum of the front stage vertical blank period A and the rear stage vertical blank period B.

As described above, when the emission signal having a high level is transferred to a gate of the emission transistor Tsw3, the emission transistor Tsw3 may be turned off, and thus, the organic light emitting diode OLED may not emit light.

For example, in a 2 frame shown in FIG. 8B, a period L where the emission signal maintains a high level in a period except the front stage vertical blank period A and the rear stage vertical blank period B may be 8H in all emission lines. That is, in all emission signals shown in FIG. 8B, a period which is included in a 2 frame period and is referred to by a bidirectional arrow and L may be 8H.

Therefore, in the 1 frame period, all organic light emitting diodes connected to the emission lines may not emit light during 8H.

To provide an additional description, the emission signal having a high level may be supplied to all emission lines included in the organic light emitting display panel during 8H except the front stage vertical blank period A and the rear stage vertical blank period B in the 1 frame period, and thus, non-emission periods of all organic light emitting diodes connected to all emission lines may be the same.

Such a feature is shown in FIG. 9.

As shown in FIGS. 8A, 8B and 9, when the emission signal having a high level is shifted from an emission line provided in an uppermost end of the organic light emitting display panel to an emission line provided in a lowermost end of the organic light emitting display panel, the emission transistor Tsw3 may be turned off, and thus, a region (a region illustrated as EM Off in FIG. 9) where light is not emitted from the organic light emitting diode OLED may sequentially move from an upper end to a lower end of the organic light emitting display panel.

In this case, based on the principle described above with reference to FIGS. 8A and 8B, an area (referred to as an emission area) of a region (i.e., an emission region (a region illustrated as LA in FIG. 9) where light is emitted from the organic light emitting diode OLED) which displays an image in the organic light emitting display panel may be constant at all timings during the 1 frame period.

Therefore, according to the present disclosure, since an emission area of the organic light emitting display panel is continuously maintained to be constant in one frame period despite the duty driving mode being applied, a current supplied to the organic light emitting display panel may be maintained to be constant, and thus, a luminance deviation may not occur in each region of the organic light emitting display panel.

Therefore, according to the present disclosure, since an emission area of the organic light emitting display panel is continuously maintained to be constant in one frame period despite the duty driving mode being applied, a current supplied to the organic light emitting display panel may be maintained to be constant, and thus, a luminance deviation may not occur in each region of the organic light emitting display panel.

That is, according to the present disclosure, a variation of the first driving voltage ELVDD supplied to an organic light emitting diode may be reduced even when the duty driving mode is applied, thereby implementing a high-quality organic light emitting display apparatus.

The above-described feature, structure, and effect of the present disclosure are included in at least one aspect of the present disclosure, but are not limited to only one aspect. Furthermore, the feature, structure, and effect described in at least one aspect of the present disclosure may be implemented through combination or modification of other aspects by those skilled in the art. Therefore, content associated with the combination and modification should be construed as being within the scope of the present disclosure.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. An organic light emitting display apparatus comprising:

an organic light emitting display panel including a plurality of pixels each including an emission transistor that controls a timing in which an organic light emitting diode emits light;

a gate driver outputting gate pulses to a plurality of gate lines provided in the organic light emitting display panel;

an emission driver provided in the organic light emitting display panel and outputting an emission signal that controls turn-on and turn-off of the emission transistor to an emission line connected to the emission transistor;

a data driver outputting data voltages to a plurality of data lines provided in the organic light emitting display panel; and a controller supplying a first signal and a second signal to the emission driver through one transfer line, wherein the first signal is generated for driving the emission driver when each frame starts, and the second signal is generated for driving the emission driver and has a period shorter than one frame period, and wherein the emission driver generates the emission signal through an emission start signal transferred through the one transfer line.

2. The organic light emitting display apparatus of claim 1, wherein a period between one pulse and another pulse which configure the second signal is the same as a data voltage output period for which data voltages are output to all of the plurality of pixels during the one frame period.

3. The organic light emitting display apparatus of claim 1, wherein the controller controls number and width of a pulse of the second signal according to a duty control signal input from an external system.

4. The organic light emitting display apparatus of claim 1, wherein the emission line includes a plurality of emission lines provided in the organic light emitting display panel.

5. The organic light emitting display apparatus of claim 4, wherein the plurality of emission lines are arranged in parallel with the plurality of gate lines, the emission signal is output to each of the plurality of emission lines, and the emission driver outputs the emission signal, generated by shifting the emission start signal, to each of the plurality of emission lines in a predetermined order.

6. The organic light emitting display apparatus of claim 1, wherein each of the plurality of pixels further comprises:

a switching transistor connected to one of the plurality of data lines and one of the plurality of gate lines;

a driving transistor connected between the organic light emitting diode and a driving voltage supply terminal, to which a first driving voltage is supplied, and turned on or off based on a gate voltage supplied from the switching transistor; and an emission transistor connected between the driving voltage supply terminal and the driving transistor and turned on or off based on the emission signal.

7. The organic light emitting display apparatus of claim 1, wherein the controller comprises an emission control signal generator generating the emission start signal for controlling the emission driver.

8. The organic light emitting display apparatus of claim 7, wherein the emission control signal generator comprises:

a first signal generator generating the first signal;

a second signal generator generating the second signal; and an OR gate performing an OR operation on the first signal and the second signal to generate the emission start signal.

9. The organic light emitting display apparatus of claim 8, wherein the first signal comprises a first pulse output after a vertical synchronization signal defining the one frame period is output.

10. An organic light emitting display apparatus comprising:

an organic light emitting display panel including a plurality of pixels each including an emission transistor that controls a timing in which an organic light emitting diode emits light; an emission driver provided in the organic light emitting display panel and outputting an emission signal that controls turn-on and turn-off of the emission transistor to an emission line connected to the emission transistor; and a controller supplying the emission driver with a first signal generated when each frame starts and a second signal having a period shorter than one frame period, for a constant emission area of the organic light emitting display panel during the one frame period, wherein the emission driver generates the emission signal from a signal supplied from the controller.

11. The organic light emitting display apparatus of claim 10, wherein a period between one pulse and another pulse which configure the second signal is the same as a data voltage output period for which data voltages are output to all of the plurality of pixels during the one frame period.

12. The organic light emitting display apparatus of claim 10, wherein the controller controls number and width of a pulse of the second signal according to a duty control signal input from an external system.

13. The organic light emitting display apparatus of claim 10, wherein the emission line includes a plurality of emission lines provided in the organic light emitting display panel.

14. The organic light emitting display apparatus of claim 10, wherein the emission signal is output to each of the plurality of emission lines, and the emission driver outputs the emission signal, generated by shifting the emission start signal, to each of the plurality of emission lines in a predetermined order.

15. The organic light emitting display apparatus of claim 10, wherein each of the plurality of pixels further comprises:

a switching transistor connected to a data line;

a driving transistor connected between the organic light emitting diode and a driving voltage supply terminal, to which a first driving voltage is supplied, and turned on or off based on a voltage supplied from the switching transistor; and an emission transistor connected between the driving voltage supply terminal and the driving transistor and turned on or off based on the emission signal.

16. The organic light emitting display apparatus of claim 10, wherein the controller comprises an emission control signal generator generating a signal for controlling the emission driver.

17. The organic light emitting display apparatus of claim 16, wherein the emission control signal generator comprises:

a first signal generator generating the first signal;

a second signal generator generating the second signal; and an OR gate performing an OR operation on the first signal and the second signal to generate the signal for controlling the emission driver.

18. The organic light emitting display apparatus of claim 16, wherein the first signal comprises a first pulse output after a vertical synchronization signal defining the one frame period is output.

* * * * *